United States Patent [19]

New

[11] Patent Number: 4,922,726

[45] Date of Patent: May 8, 1990

[54] HEAT PUMP SYSTEM

[75] Inventor: David M. New, Homer, N.Y.

[73] Assignee: Carrier Corporation, Syracuse, N.Y.

[21] Appl. No.: 936,425

[22] Filed: Dec. 1, 1986

[51] Int. Cl.[5] ..... F25B 27/00

[52] U.S. Cl. ..... 62/235.1; 62/324.1

[58] Field of Search ..... 237/2 B; 62/324.1, 235.1

[56] References Cited

U.S. PATENT DOCUMENTS 4,256,475 3/1981 Schafer .

4,392,359 7/1983 Franklin ..... 237/2 B X

*Primary Examiner*—Henry A. Bennett

*Attorney, Agent, or Firm*—Dana F. Bigelow

[57] ABSTRACT

A heat pump system communicating water from a remote source for heat exchange with a localized refrigerant loop including compressor and evaporator elements, said refrigerant loop further linked to a blower for additional heat exchange with respect to selected rooms and spaces which are desirably selectively heated or cooled, said compressor, evaporator and blower and additional elements packaged as a single local unit and adapted to communicate with said external water source for acquistion or disposal of heat.

7 Claims, 1 Drawing Sheet

HEAT PUMP SYSTEM

BACKGROUND OF THE INVENTION

The invention herein is directed toward the art and technology of heat pumps and more particularly ductless water source heat pumps.

At present, many heat pump systems are highly dispersed component-wise, with the refrigerant loop including both remote and localized elements, with respect to the spaces being temperature controlled. In other words, the condenser, compressor and evaporator elements linked by the refrigerant loop are remote from the spaces and rooms to be temperature controlled. This remote stationing and dispersion of elements of course causes the air heated or cooled to have to be transported through extensive and space consuming ductwork to and from the rooms and spaces being temperature controlled, thereby typically consuming inordinate amounts of space. It is of course desirable to install heat pump systems in rooms and buildings without consuming inordinate amounts of space, ventilation and air conditioning heat pump systems, particularly because of the large size.

It is additionally known that many heat pump systems employ an outdoor coil arrangement linked to the refrigerant loop, thereby splitting the system and preventing localization of elements in the refrigerant loop portion of the heat pump system, and additionally preventing effective reduction of system size.

Beyond such general consideration of size and space, however, it is additionally desired to reduce system plenum height above the ceilings of the spaces in which such systems are to be installed for heating and cooling. Additionally, it is desirable for the primary indoor portions of the system to be locally packaged within or immediately adjacent the spaces to be temperature controlled. It is further desirable to minimize or eliminate the air ductwork required to implement the heat pump system.

SUMMARY OF THE INVENTION

Pursuant to the invention herein, a compact, indoor and ductless heat pump arrangement, including localized, indoor compressor, evaporator and condenser elements, arranged in a completely indoor refrigerant loop, together with associated valves and heat transfer fluid, is accordingly installable in the plenum region between the ceiling and next upper floor of a typical building structure, in close proximity to the air terminals associated with the rooms and spaces to be air conditioned and/or heated.

One version of the invention, in particular, is directed the toward hanging installation of the indoor elements of the heat pump arrangement, including compressor, evaporator, condenser and associated valves and refrigerant fluid, for installation in a receiving aperture of the ceiling of the rooms and spaces to be temperature controlled.

Even more particularly, the invention is directed toward localized mounting of the entire combination of these indoor heat pump elements, i.e. compressor, evaporator, condenser and associated valves and refrigerant fluid, in a single localized unit, which can be hang mounted in the ceiling of the rooms or spaces to be temperature controlled. The package includes condenser, compressor and evaporator elements and the pipes or tubes for transmitting a selected closed loop refrigerant such as for example Freon therebetween, and having a heat exchanger for transferring heat with respect to tubes or pipes leading to an external location where heat is either to be acquired or dumped. These tubes or pipes also contain a selected heat transfer fluid, such as, according to a preferred version of the invention, water, which is pump circulated between its storage location and the heat exchanger of the refrigerant loop.

DESCRIPTION OF THE PREFERRED EMBODIMENT

Figure 1:
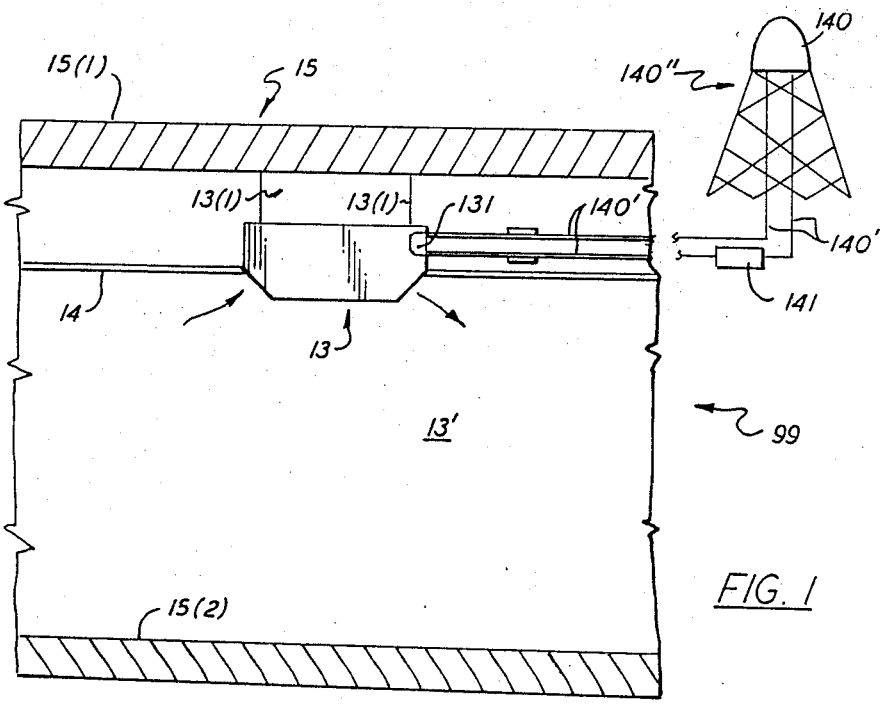
FIG. 1 shows the heat pump arrangement according to the invention herein, in side schematic view, with the primary localized elements hanging from the underside of a next upper floor structure and extending for operation through the ceiling of the space to be temperature controlled.

FIG. 1 shows the heat pump arrangement 13 of the invention herein as it would be installed in the ceiling of a typical building containing spaces 13' to be temperature controlled with arrows 16 showing air flow through the heat pump arrangement as will be discussed. As is well known, many contemporary building structures employ false ceilings 14 which hang from the floors 15 immediately above. In particular, FIG. 1 shows first and second floors respectively 15(1) and 15(2) with ceiling 14 associated with floors 15(1).

This permits the convenient installation of ductwork (not shown) for heating, ventilation and air conditioning, as well as the placement of electrical lines and conduits (also not shown) for power and telephone purposes, inter alia. As useful and as expansive as these spaces are in modern buildings, the employment of such an elaborate system of air ducts in these spaces is nonetheless expensive and burdensome.

A solution which avoids part of such an extravagance is to install a heat pump arrangement 13, according to the invention, directly in these spaces. Clearly, this does not eliminate the problem of transferring heat with respect to locations outside the building, but it does eliminate the problem of transporting immense quantities of air through ductwork to specific regions within the building.

With a heat pump arrangement 13 according to the invention herein, heat exchange is enabled by employment of a heat exchanger 131 within the localized, i.e. close to the spaces to be temperature controlled, portions of the heat pump arrangement 13. A suitable heat transfer fluid, as will be seen, can then be circulated to the localized portions of arrangement 13 including its refrigerant loop, from a remote source or location 140.

In particular, warm or cool water from a source 140 of warm or cool water, such as an external water tower 140'', is circulated through tubes or pipes 140' in communication with heat exchanger 131 in heat pump arrangement 13, under direction of pump 141. Typically, the water from source 140 is, relatively speaking, cool in the winter and warm in the summer. Operation of heat pump arrangement 13 to heat internal spaces 13' in the winter and to cool them in the summer will thus render the water supplied from source or location 140 hotter and colder, respectively.

Figure 2:
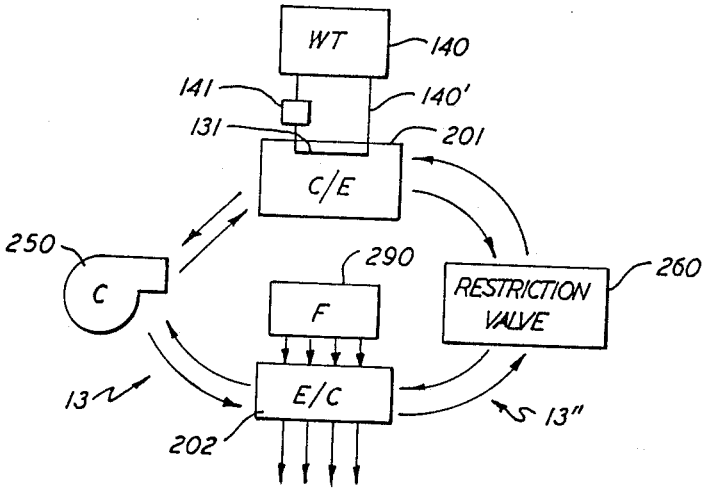
FIG. 2 shows in schematic form both localized indoor and outdoor portions of the heat pump component arrangement according to the invention herein.

FIG. 2 shows, in terms of a general scheme, the preferred or best mode of arrangement 13, according to the invention herein. Water or heat transfer fluid from source 140 subject to pump 141 passes through pipes 140' and heat exchanger 131, as generally indicated in FIG. 1. The water or heat transfer fluid in pipes 140' operates to communicate thermally with heat transfer element 201 included as part of the localized portions of heat pump arrangement 13. Heat transfer element 201 is operated selectively either as a condenser or an evaporator. Heat pump arrangement 13 further includes indoor coil element 202 which acts as a complement to element 201. That is, when indoor coil element 202 acts as condenser, heat transfer element 201 will operate as an evaporator for purposes of the refrigerant loop 13".

As is well known, refrigerant (e.g. Freon) can be transported in a closed loop 13" between elements 201 and 202, under flow direction of compressor 250. According to one best mode or preferred scheme, the compressor 250 is shown to be reversible in direction of output flow. Alternatively, commonly known four-way valves (not shown) can be employed in lieu of the compressor itself being reversible. Refrigerant in closed loop 13" itself flows through a restrictor valve 260, or a similarly functioning arrangement well-known in the art, to modify the pressure level of the refrigerant present in the loop 13", and to permit a phase change in the selected refrigerant material of interest,. As already suggested, one of elements 201 and 202 acts as a condenser, effective for taking heat out of the indoor, localized refrigerant system and additionally effective for changing the refrigerant into liquid phase. The other of the elements 201, 202 as indicated acts as an evaporator, putting heat into the refrigerant system, and tending to cause evaporation of the refrigerant, particularly once it arrives at lower pressure on the far side of restrictor valve 260.

Additionally, According to the invention, a fan or blower 290 is suitably mounted to be effective for blowing air to be heated or cooled through heat exchanger element 202. When heat exchanger element 202 acts as an evaporator, the air blown therethrough is cooled; when it acts as a condenser, the air is heated. The fan 290 takes air from spaces 13' to be temperature controlled as indicated in FIG. 1 and after heating or cooling it, blows it back in the same spaces 13'. FIG. 1 shows only one localized arrangement 99 of many which could according to the invention herein be connected in series or parallel with pipes 140' of tower 140".

By virtue of heat exchanger 131 in element 201, heat is either added to or removed from the refrigerant in loop 13". During winter, heat is put into the loop 13" from piping 140' and water source 140, because during winter element 201 is engaged as an evaporator, which cools the water in piping 140' even further than it already is under wintry conditions. However, since water in its unfrozen state remains over 32° Fahrenheit, which is warm, relatively speaking, the water source 140" nonetheless acts as a heat source during the winter.

In summer, the situation is analogous, but reversed. In particular, under summer conditions, as is easily understood, element 201 is set to act as condenser, effective to reject heat from the refrigerant in loop 13" for transfer into piping 140' for deposit in water storage location 140.

While this invention has been described with reference to a particular embodiment disclosed herein, it is not confined to the details set forth herein and this application is intended to cover any modifications or changes as may come within the scope of the invention.

What is claimed is:

1. A heat pump system comprising an indoor coil and an indoor heat exchange means for engaging in heat transfer operation, refrigerant means for enabling the transport of selected refrigerant between said indoor coil and heat transfer means, compressor means for driving said selected refrigerant through said indoor coil and heat exchange means, and indoor blower means for controllably passing air over said indoor coil means into selected indoor spaces to be temperature controlled, said heat pump system additionally comprising heat transfer means for communicating a selected heat transfer fluid between said heat exchange means and an outdoor location, whereby heat transfer is accomplished between said refrigerant means and regions external to spaces being temperature controlled.

2. The system of claim 1, wherein said selected heat transfer fluid is water.

3. The system of claim 1, wherein said selected refrigerant is Freon.

4. The system of claim 1, wherein said heat pump system includes means for circulating said heat transfer fluid in said heat transfer means.

5. The system of claim 1, wherein said heat transfer fluid is circulated to said heat exchange means from an external storage means for containing heat transfer fluid.

6. A heat pump system comprising a plurality of indoor portions of elements, each portion comprising indoor coil and heat exchange means for engaging in heat transfer operation, means for enabling the transport of selected refrigerant between said indoor coil and heat transfer means, compressor means for driving said selected refrigerant through said indoor coil and heat exchange means, and indoor blower means for controllably passing air over said indoor coil into selected indoor spaces to be temperature controlled; and additionally comprising interspacial heat transfer means for exchanging heat transfer fluid with each said heat exchange means, effective thereby for transferring heat between said selected refrigerant and regions external to the indoor spaces to be temperature controlled.

7. The system of claim 6, wherein said heat transfer fluid is circulated to said heat exchange means from an external storage means for containing heat transfer fluid.

* * * * *